United States Patent [19]

Anisovich et al.

[11] 4,146,079

[45] Mar. 27, 1979

[54] PROCESS AND APPARATUS FOR CONTINUOUS CASTING OF HOLLOW INGOTS

[76] Inventors: Gennady A. Anisovich, prospekt Mira, 25V, kv. 54, Mogilev; Vadim I. Tutov, ulitsa Knorina, 10b, kv. 40, Minsk; Vladimir F. Bevza, prospekt Mira, 25V, kv. 40, Mogilev; Evgeny I. Marukovich, bulvar Jubileiny, 5, kv. 77, Mogilev; Zoya D. Pavlenko, prospekt Mira, 25V, kv. 54, Mogilev; Vasily S. Mazko, ulitsa Kosmonavtov, 26, kv. 51, Mogilev; Gennady E. Ivanov, Minskoe shosse, 61, kv. 51, Mogilev, all of U.S.S.R.

[21] Appl. No.: 813,010

[22] Filed: Jul. 5, 1977

[51] Int. Cl.[2] ..... B22D 11/00

[52] U.S. Cl. ..... 164/85; 164/421

[58] Field of Search ..... 164/85, 421, 418

[56] References Cited

U.S. PATENT DOCUMENTS

| | | | |
|---|---|---|---|
| 3,075,264 | 1/1963 | Wognum | 164/85 X |
| 3,410,333 | 11/1968 | Woodburn, Jr. | 164/85 X |

FOREIGN PATENT DOCUMENTS

| | | | |
|---|---|---|---|
| 4539345 | 11/1970 | Japan | 164/85 |
| 275326 | 2/1970 | U.S.S.R. | 164/85 |

*Primary Examiner*—Robert L. Spicer, Jr.

*Attorney, Agent, or Firm*—Lackenbach, Lilling & Siegel

[57] ABSTRACT

A process for continuous casting of hollow ingots wherein the rate of heat removal from the surface of an ingot within a mold is changed gradually over the mold height from a given maximum value in the ingot skin formation zone to a given minimum value as the ingot emerges from the mold. The speed of the continuous ingot withdrawal from the mold is increased gradually during each withdrawing cycle from zero to the maximum value for apredetermined length of time. An apparatus in accordance which comprises a water-cooled mold which is made in the form of an inverted truncated cone with the diameter of any of its bases being substantially less than its height. A part of the upper portion of the mold being cylinder-shaped and formed with a plurality of slots. The diameter of projections formed by the slots is slightly less than that of the top base of the frustoconical section, with the walls of the slots passing smoothly into projections. Mounted above the mold is a detachable screen adapted to control the rate of heat removal from the ingot outside the mold.

7 Claims, 2 Drawing Figures

PROCESS AND APPARATUS FOR CONTINUOUS CASTING OF HOLLOW INGOTS

FIELD OF THE INVENTION

Figure 1:
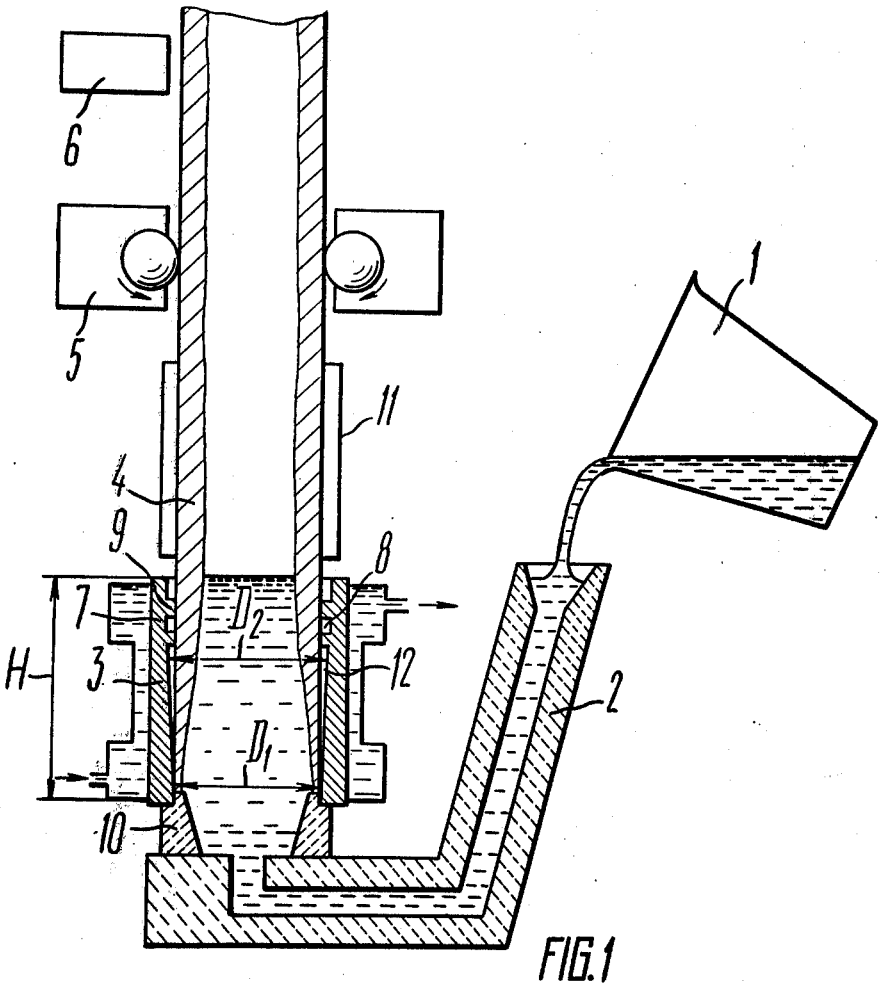

The present invention relates to the field of foundry practice, and more particularly to processes and apparatus for continuous casting of hollow ingots.

The herein proposed process and apparatus are well suited for use in producing workpieces for cylinder liners, piston rings, sleeves and such like articles and responsible machinery parts, as well as pig-iron sewer pipes, radiant steel tubes, ball races, antifriction bushings of nonferrous metals and alloys.

BACKGROUND OF THE INVENTION

For example, there is known a process and apparatus for continuous casting of hollow ingots (of. FRG Pat. No. 804,840, cl. B 22d, 11/06, 1951).

The process of the patent referred to above includes molten metal being continuously delivered through a bottom gate into a mold with an open top end. The skin of metal solidifying at the interior surface of the mold is pulled upwardly. The solidified metal skin forms the ingot body.

There is also known a freezing-out process for continuous casting of hollow ingots and an apparatus for effecting same (of, "Calculation of Ingots", by A. I. Vejnik, Moscow Publishers, Engineering, 1964, pp. 239–261; "Thermodynamics of a Casting Mold", by A. I. Vejnik, Moscow Publishers, Engineering, 1968, pp. 252–264; and "Chill Mold", by Vejnik, Moscow Publishers, Engineering, 1972, pp. 127–137).

The aforementioned process is carried out with maximum rate of heat removal from the surface of solidifying ingot throughout the period of its formation in the mold. The withdrawal of the ingot is conducted continuously in a stepwise manner. An apparatus for carrying the continuous casting process into effect comprises a water-cooled mold having a working sleeve member with the interior surface thereof being cylindrical in shape, a coupling casing and a bottom gate through which molten metal is delivered into the interior of the mold.

The disadvantage of the known continuous casting processes and apparatus lies in the absence of a control system for regulating the intensity of heat removal the ingot within a mold. This, in turn, prevents from producing an ingot with a uniform thickness of its wall and with a prescribed structure and properties of its metal. Where pig iron is used for continuous casting, it is impossible to produce ingots free from hard spots and with a prescribed structure. Since the initial solidification of skin is effected at a vigorous heat dissipation, the crystallization of pig iron is accompanied by the formation of austenite dendrites and ledeburite eutectic. Vigorous heat dissipation or removal from the surface of solidifying ingot throughout the entire period of its formation (mean coefficient of heat removal is $(2:3)\cdot 10^3 W/m^2\cdot$degrees), rules out decomposition of eutectic cementite. The resultant ingot has hard spots on its outer surface, with the structure of mottled iron in other parts thereof.

Another serious disadvantage of the known processes is low stability of the continuous casting process per se. The reason for this is an enormous dynamic stress acting upon the solidifying initial skin of ingot during each cycle of its withdrawal. At the initial stage of its formation the skin has a high temperature ranging, for example during casting of pig iron, from 950 to 1050° C. Tensile strength of pig iron at such temperatures is within the range of from 0.1 to 0.45 $kg/mm^2$. Sharp increase in the ingot withdrawal speed in the beginning of each cycle results in the rupture of metal skin and, consequently, in the termination of the casting process.

It is, therefore, an object of the present invention to produce ingots featuring high quality metal.

Another object of the invention is to provide a process and apparatus for continuous casting of hollow ingots, whereby it will be possible to control the process of ingot formation by way of regulating the rate of heat removal from the continuous ingot.

These and other objects and features of the invention are accomplished by the provision of a process for the continuous casting of hollow ingots, comprising the steps of delivering molten metal through a bottom gate into the interior of a water-cooled mold and continuous withdrawing in an upward direction and in a stepwise manner the skin of solidified metal forming at the mold interior surface into an ingot, according to the invention, the rate, of heat emission from the surface of the ingot within the mold is changed gradually over the mold height from a given maximum value in the metal skin formation zone to a given minimum value at the emergence of the ingot from the mold, the speed of the ingot continuous withdrawal from the mold being increased gradually during each withdrawing cycle from zero to the maximum value for a length of time equal to a half the travelling time of the ingot, said speed being then gradually reduced back to zero for the same amount of time.

It is expedient that the rate of heat emission from the ingot at each point over the height of the mold be determined from the formula:

$$\alpha = a(h/H)^b,$$

where

- $\alpha$ - is the coefficient of heat emission from the ingot surface, $(W/m^2.deg)$;
- h - is the height of a mold, over which is determined the rate of heat emission, (m);
- H - is the overall height of the mold, (m);
- a - is an empirical coefficient depending upon the ingot material $(W/m^2.deg)$;
- b - is a nondimensional empirical coefficient depending upon the ingot material.

The speed of the ingot withdrawal from the mold during each withdrawing cycle can be determined from the formula:

$$\left.\begin{aligned} \frac{V_t}{V_{max}} &= A_o + \sum_{n=1}^{\infty} An \cdot \cos(n\omega t - \epsilon_n) \text{ when } \pi_k \leqq \omega t \leqq \pi_{(k+1)} \\ \frac{V_t}{V_{max}} &= A_o + \sum_{n=1}^{\infty} An \cdot \cos(n\omega t - \epsilon_n) = 0 \text{ when } \pi_{(k+1)} \leqq \omega t \leqq \pi_{(k+2)} \end{aligned}\right\}$$

where

- $V_t$ - is the current value of the ingot withdrawal speed during its travelling cycle, (m/sec);

$V_{max}$ - is the maximum value of the ingot withdrawal speed during its travelling cycle, (m/sec);

$A_o$ - is the free coefficient of a Fourier series;

$A_n$ - is the amplitude of oscillation of the corresponding harmonic component of the Fourier series;

n - is the sequence of natural numbers 1,2,3,4 . . . ;

$\omega = 2\pi/T$ is the pulsatance of the ingot travelling speed, ($sec^{-1}$);

T - is the oscillation period of the ingot travelling speed (sec);

t - is the current time of the ingot withdrawal, (sec);

$\epsilon_n$ - is the epoch angle of the corresponding harmonic component of the Fourier series, (rad);

K - is the sequence of even numbers 0,2,4,6, . . . .

The heat removal rate for pig iron can be regulated over the entire height of the mold, the empirical coefficients a and b being selected within the following range:

$$200 \leqq a \leqq 2500$$

$$-1.2 \leqq b \leqq -0.6$$

When steel is used for casting of hollow ingots, the rate of heat removal is usually regulated over the entire height of the mold, the empirical coefficients being selected within the following range:

$$1000 \leqq a \leqq 1200$$

$$-0.6 \leqq b \leqq -0.1$$

With nonferrous metals being used for casting of hollow ingots, the rate of heat removal is regulated over the entire height of the mold, the empirical coefficients being selected within the following range:

$$300 \leqq a \leqq 10000$$

$$-0.7 \leqq b \leqq -0.3$$

The aforesaid object of the invention is likewise attained in a continuous casting apparatus comprising a water-cooled mold connected through a coupling sleeve with a bottom gate system, a withdrawal-roll means for continuous upward pulling of an ingot, and a cut-off means for cutting the continuous ingot to lengths. According to the present invention, the mold is made in the form of an inveted truncated cone with the diameter of any base thereof being substantially less than its height, the upper portion of said mold being cylinder-shaped and formed at the interior surface thereof with a plurality of annular slots.

The diameter of projections formed by the slots should be slightly less than that of the upper base of the truncated cone, and the passages from projections to the slots should be made smooth.

It is advantageous that the apparatus of the present invention be provided with a detachable screen adapted to regulate the rate of the ingot cooling and mounted above the mold and in direct proximity to the ingot.

The provision of the screen makes it possible to regulate the rate of heat removal from the ingot and control the process of its formation, thereby producing continuous ingots of high-quality metal.

Figure 2:
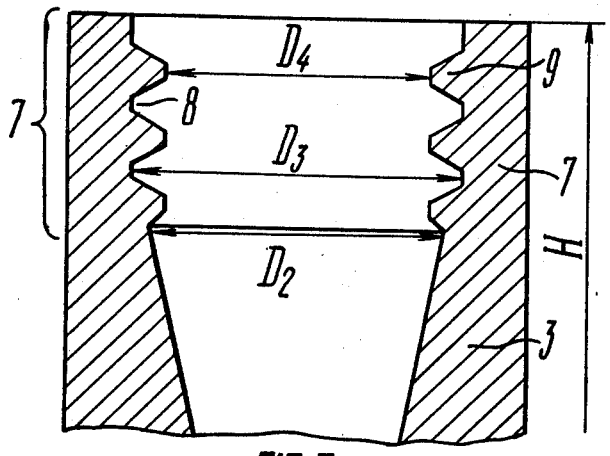

The invention will now be explained in greater detail with reference to specific preferred embodiments thereof which are represented in the accompanying drawings. In the drawings:

FIG. 1 is a general view of a continuous casting apparatus, according to the invention; and FIG. 2 is an axial section view of a mold, shown at the portion formed with slots, according to the invention.

Molten metal is continuously delivered by a ladle 1 (see FIG. 1) through a bottom gate 2 into the interior of a water-cooled mold 3. The skin of metal solidifying at the interior surface of the mold 3, which is actually the body of an ingot 4, is withdrawn continuously in a stepwise manner and in an upward direction with the aid of a withdrawal-roll means 5. As the continuous ingot 4 issues from the mold 3, it is directed to a cut-off station 6 to be cut to any desired lengths and, stowed away (the stowage is not shown).

The withdrawal of the ingot 4 is carried out in a stepwise manner or follows an intermittent cycle with a time period T. During half the aforesaid period the ingot 4 is moving in relation to the mold 3, while during the second half of the same period it remains stationary in relation to the mold 3.

With each moving cycle of the upwardly withdrawn ingot 4, there is freed at the bottom part of the mold 3 a portion thereof equal in size to the distance covered by the upwardly shifted ingot 4. It is just at this portion that molten metal comes into contact with the working surface of the mold 3, which results in rapid freezing of the metal and formation of the metal skin fused with the section solidified earlier. The rate of heat removal from the ingot 4 within the mold 3 is changed gradually over the height of the mold 3 from a given maximum value in the ingot skin formation zone to a given minimum value at the emergence of the ingot 4 from the mold 3.

At the initial stage of solidification the rate of heat emission from the ingot 4 is high enough, the coefficient of heat emission $\alpha$ from the solidifying ingot being $16 \cdot 10^3$ $W/m^2 \cdot deg$. Thereafter, the rate of heat emission from solidifying ingot 4 is determined from the following formula:

$$\alpha = a(h/H)^b, \quad (1)$$

where $\alpha$ - is the coefficient of heat emission from the ingot surface, ($W/m^2 \cdot deg$);

h - is the height of the mold, over which is determined the intensity of heat removal, m;

H - is the overall height of the mold, m;

a - is an empirical coefficient depending upon the ingot material, $W/m^2 \cdot deg$;

b - is a nondimensional empirical coefficient depending upon the ingot material.

The speed of withdrawal of the ingot 4 from the mold 3 is gradually increased during each withdrawal cycle from zero to a maximum value for a length of time equal to a half the time period of the withdrawal cycle, the withdrawal speed being as well gradually decreased back to zero for the same amount of time, which rules out the possibility of sudden dynamic stress acting on the forming ingot 4. The withdrawal of the ingot 4 should be carried on continuously in a stepwise manner, changing the ingot travelling speed throughout the withdrawal cycle in accordance with the formula:

$$\frac{V_t}{V_{max}} = A_o + \sum_{n=1}^{\infty} An \cdot \cos(n\omega t - \epsilon_n) \text{ when } \pi_k \leqq t \leqq \pi_{(k+1)}$$

-continued $$\frac{V_t}{V_{max}} = A_o + \sum_{n=1}^{\infty} An \cdot \cos(n\omega t - \epsilon_n) = 0 \text{ when } \pi_{(k+1)} \leqq t \leqq \pi_{(k+2)}$$

where $V_t$-is the current value of the ingot withdrawal speed during its travelling cycle, m/sec;

$V_{max}$ - is the maximum value of the ingot withdrawal speed during its travelling cycle, m/sec;

$A_o$ - is the free coefficient of a Fourier series;

$A_n$ - is the amplitude of oscillation of the corresponding harmonic component of the Fourier series;

n - is the sequence of natural numbers 1, 2, 3, 4, . . .;

$\omega = 2\pi/T$ is the pulsatance of the ingot travelling speed, $sec^{-1}$;

T is the oscillation period of the ingot travelling speed sec;

t - is the current time of the ingot withdrawal, sec;

$\epsilon_n$ - is the epoch angle of the corresponding harmonic component of the Fourier series, rad;

K - is the sequence of even numbers 0,2,4,6, . . .

Should the law of change of the ingot speed travelling be preset with an accuracy of 1 to 2 percent, suffice it to have five terms of the Fourier series.

With pig iron being poured into the interior of the mold 3, the rate of heat removal is regulated over the entire height of the mold 3 according to the afore-mentioned formula (1), the empirical coefficients a and b being selected within the following range:

$$200 \leqq a \leqq 2500$$

$$-1.2 \leqq b \leqq -0.6$$

EXAMPLE 1

An ingot of 170 mm in diameter and 14.4 mm thick in the wall cross section, to be used as a workpiece for piston rings from pig iron of the following composition: 3.15% C; 1.7% Si; 1.43% Mn; 0.03% S; 0.45% P; 0.32% Cr; 0.5% Ni; said ingot being produced in the mold of 0.25 m high as follows.

The rate of heat removal from the surface of the ingot 4 within the mold 3 is regulated over the entire height of the mold 3 according to the formula:

$$\alpha = a(h/H)^b,$$

the empirical coefficients being $$a = 367$$

$$b = -0.95$$

As a result, the following is obtained for the given example:

$$\alpha = 367(h/0.25)^{-0.95}$$

At the initial stage of formation of the ingot 4, the coefficient of heat emission in the ingot skin formation zone is 6287W/m²·deg. Such a rate of heat emission causes sharp drop of temperature at the ingot surface from crystallization temperature down to 873° C. at an average rate of 100 degrees per second. The crystallization of pig iron is accompanied by the formation of austenite dendrites and separate inclusions of graphite. As the ingot 4 continues its upward movement during succeeding withdrawal cycles, the ingot section under consideration is shifted upwardly to the upper area of the mold 3 wherein the rate of heat emission gradually decreases. For example, the coefficient of heat emission $\alpha$ at the height h = 100 mm is 876 W/m²·deg, which creates optimal conditions for crystallization of pig iron, accompanied by the formation of austenite dendrites and graphite eutectic, and prevents the formation of cementite. In the upper area of the mold 3 wherein the coefficient of heat emission is only 300 to 400 W/m²·deg, the temperature of the outer surface of the ingot 4 raises up to 980° C. thereby to create conditions for decomposition of cementite formed in the outer layers of the ingot 4 during initial solidification of the metal skin. The withdrawal of the ingot 4 is carried on continuously in a stepwise manner at an average speed of 0.008 m/sec, its travelling speed during withdrawal cycle being changed according to the formula:

$$\left.\begin{array}{l} \dfrac{V_t}{V_{max}} = A_o + \sum\limits_{n=1}^{\infty} An \cdot \cos(n\omega t - \epsilon_n) \\ \qquad\qquad \text{when } \pi_k \leqq \omega t \leqq \pi_{(k+1)} \\ \dfrac{V_t}{V_{max}} = A_o + \sum\limits_{n=1}^{\infty} An \cdot \mathrm{Cos}(n\omega t - \epsilon_n) = 0 \\ \qquad\qquad \text{when } \pi_{(K+1)} \leqq \omega t \leqq \pi_{(k+2)} \\ V_{max} = 0.032 \text{ m/sec;} \end{array}\right\}$$

$W = 6.28\ sec^{-1}$;

$Ao = 3\ 0.23$; $A_1 = 0.4005$; $A_2 = 0.23$;

$A_3 = 0.1289$; $A_4 = 0.0363$; $A_5 = 0.0034$;

$\epsilon_1 = 1/2$; $E_2 = -\pi$; $\epsilon_3 = -\pi/2$; $\epsilon_4 = \pi/2$; $\epsilon_5 = -\pi/2$ As a result, the change of speed during withdrawal cycle is obtained from the formula:

$$\left.\begin{array}{l} \dfrac{V_t}{0.032} = 0.23 + 0.4005 \cdot \cos(6.28t - \frac{\pi}{2}) + \\ 0.23 \cdot \cos(2.68t + \pi) + 0.1289 \cdot \cos(3 \cdot 6.28t + \frac{\pi}{2}) + \\ 0.0363 \cdot \cos(4 \cdot 6.28t - \frac{\pi}{2}) + 0.0034 \cdot \cos(5 \cdot 6.28t + \frac{\pi}{2}) \\ \qquad\qquad \text{when } \pi_k = 6.28t \leqq \pi_{(k+1)} \\ \dfrac{V_t}{0.032} = 0 \\ \qquad\qquad \text{when } \pi_{(k+1)} \leqq 6.28t \leqq \pi_{(k+2)} \end{array}\right\}$$

Thus, a continuous stable casting process is capable of yielding an ingot 4 which is uniform in its cross-section, having no hard spots and with pearlitic metallic matrix, containing small-, and medium-flaked graphite inclusions in the middle and inner layers thereof. Present in the ingot's outer layer, with a thickness of 1.5 to 2.0 mm is interdendrite graphite. The pig iron hardness is 269 HB, its tensile strength is 41.5 kg/mm², and density thereof being 7300 kg/m³. During subsequent mechanical treatment of ingots, no defects were traced down to the casting process. The produced articles had been found to comply with requirements for piston rings.

EXAMPLE 2

An ingot of 170 mm in diameter and with the wall thickness of 14 mm, intended as a workpiece for cylinder liners from pig iron of the following composition: 3.2% C; 1.98% Si; 0.78% Mn; 0.03% S; 0.23% P; 0.19% Cr; 0.2% Ni; 0.73% Cu; said ingot being cast in the mold of 0.2 m high in the following manner.

The rate of heat removal from the surface of the ingot 4 within the mold 3 is regulated over the entire height of the mold 3. The empirical coefficients in the aforementioned formula (1) are the following:

$$a = 495,\ b = -0.87$$

The result obtained is $$\alpha = 495(h/0.2)^{-0.87}$$

The withdrawal of the ingot 4 is carried on continuously in a stepwise manner at an average speed of 0.014 mm/sec, its travelling speed being charged during withdrawal cycle according to the aforementioned formula (2), where $V_{max} = 0.056$ m/sec;
$\omega = 6.28\ \text{sec}^{-1}$;
$A_o = 0.23$; $A_1 = 0.4005$; $A_2 = 0.23$;
$A_3 = 0.1289$; $A_4 = 0.0863$; $A_5 = 0.0034$;

$$\epsilon_1 = \pi/2;\ \epsilon_2 = -\pi;\ \epsilon_3 = -\pi/2;\ \epsilon_4 = \pi/2;\ \epsilon_5 = \pi/2$$

As a result, the change of speed of the ingot 4 during withdrawal cycle is obtained from the formula:

$$\left.\begin{array}{ll} \frac{V_t}{0.056} = 0.23 + 0.4005 \cdot \cos(6.28t - \frac{\pi}{2}) + & \\ 0.23 \cdot \cos(2 \cdot 6.28t + \pi) + 0.1289 \cdot \cos(3 \cdot 6.28t + \frac{\pi}{2}) + & \\ 0.0363 \cdot \cos(4 \cdot 6.28t - \frac{\pi}{2}) + & \\ 0.0034 \cdot \cos(5 \cdot 6.28t + \frac{\pi}{2}) & \\ \frac{V_t}{0.056} & \text{when } \pi_k \leqq 6.28 + \leqq \pi_{(k+1)} \\ \frac{V_t}{0.056} = 0 & \text{when } \pi_{(k+1)} = 6.28t \leqq \pi_{(k+2)} \end{array}\right\}$$

Thus, a stable continuous casting process yields an ingot 4 of uniform cross-section, without hard spots and with pearlitic metallic matrix, containing small and medium-flaked graphite inclusions. Hardness of the pig iron is 241 HB, its tensile strength is 35.8 kg/mm$^2$, and density thereof being 7285 kg/m$^3$. During subsequent mechanical treatment of the cast ingots, no defects therein were traced down to the casting process. The produced articles had been found to comply with requirements for cylinder liners. The durability of the cylinder liners produced by the herein proposed process was 2–2.5 times higher than that of the cylinder liners cast by the conventional processes.

EXAMPLE 3

An ingot of 57 mm in diameter and with the wall thickness of 3.5 mm for producing a sewer pipe from pig iron of the following composition: 3.52% C; 2.18%; 0.72% Mn; 0.03% S; 0.10% P, said ingot being cast in the mold of 0.15 m high as follows.

The rate of heat removal from the surface of the ingot 4 within the mold 3 is regulated over the entire height of the mold 3. The empirical coefficients in the aforementioned formula (1) are the following:

$$a = 280;\ b = -1.15$$

This gives $$\alpha = 280(h/0.15)^{-1.15}$$

The withdrawal of the ingot 4 is carried on continuously in a stepwise manner at an average rate of 0.04 m/sec, its travelling speed being changed during withdrawal cycle according to the aforementioned formula (2), where $V_{max} = 0.167$ m/sec;
$\omega = 8.48\ \text{sec}^{-1}$;
$A_o = 0.23$; $A_1 = 0.4005$; $A_2 = 0.23$;
$A_3 = 0.1289$; $A_4 = 0.0363$; $A_5 = 0.0034$;

$$\epsilon_1 = \pi/2;\ \epsilon_2 = -\pi;\ \epsilon_3 = \pi/2;\ \epsilon_4 = \pi/2;\ \epsilon_5 = -\pi/2$$

As a result, the change of speed of the ingot 4 during withdrawal cycle is obtained from the formula:

$$\left.\begin{array}{ll} \frac{V_t}{0.167} = 0.23 + 0.4005 \cdot \cos(8.48t - \frac{\pi}{2}) + & \\ 0.23 \cdot \cos(28.48t + \pi) + 0.1289 \cdot \cos(3 \cdot 8.48t \frac{\pi}{2}) + & \\ 0.0363 \cdot \cos(4 \cdot 8.48t - \frac{\pi}{2}) + 0.0034 \cdot \cos(8.48t + \frac{\pi}{2}) & \\ \frac{V_t}{0.167} & \text{when } \pi_k \leqq 8.48 \leqq \pi_{(k+1)} \\ \frac{V_t}{0.167} = 0 & \text{when } \pi_{(k+1)} \leqq 8.48t \leqq \pi_{(k+2)} \end{array}\right\}$$

Thus, a stable continuous casting process is enabled to yield the ingot 4 of uniform cross-section, without hard spots, featuring high quality of inner and outer surfaces thereof. Tensile strength of the pig iron is 29 kg/mm$^2$, its density being 7280 kg/m$^3$. The pipe produced from the ingot 4 has been tested to withstand water pressure of 15 atmospheres showing no leakage or precipitation.

When steel is poured into the mold interior, it is necesssary to regulate the rate of heat removal over the entire height of the mold according to the formula (1), the empirical coefficients a and b being selected within the following range:

$$1000 \leqq a \leqq 12000,$$

$$-0.6 \leqq b \leqq -0.1$$

EXAMPLE 4

An ingot of 100 mm in diameter and with the wall thickness of 13 mm for producing ball races from steel of the following composition: 1.3% Cr; 1.01%C; 0.33% Si; 0.25% Mn; 0.015% S; 0.027% P; 0.30% Ni; 0.25% Cu; said ingot being cast in the mold of 0.2 m high in the following manner.

The rate of heat removal from the surface of the ingot 4 within the mold 3 is regulated over the entire height of the mold 3. The empirical coefficients in the aforementioned formula (1) being $$a = 4630,\ b = -0.43$$

Thus, the change in the rate of heat removal is determined from the formula $$\alpha = 4630(h/0.2)^{-0.43}$$

The withdrawal of the ingot 4 is carried on continuously in a stepwise manner at an average rate of 0.011 m/sec, its travelling speed being changed during withdrawal cycle according to the formula (2) where $V_{max} = 0.045$ m/sec;
$\omega = 6.28\ \text{sec}^{-1}$;
$A_o = 0.23$; $A_1 = 0.4005$; $A_2 = 0.23$;
$A_3 = 0.1289$; $A_4 = 0.0363$; $A_5 = 0.0034$.

$$\epsilon_1 = \pi/2;\ \epsilon_2 = \pi;\ \epsilon_3 = \pi/2;\ \epsilon_4 = \pi/2;\ \epsilon_5 = \pi/2$$

As a result, the change of speed of the ingot 4 during withdrawal cycle is obtained from the formula:

$$\left.\begin{aligned}
&\frac{V_t}{0.045} = 0.23 + 0.4005 \cdot \cos(6.28t - \frac{\pi}{2}) + \\
&0.23 \cdot \cos(2 \cdot 6.28t + \pi) + 0.1289 \cdot \cos(3 \cdot 6.28t + \frac{\pi}{2}) + \\
&0.0363 \cdot \cos(4 \cdot 6.28t - \frac{\pi}{2}) + 0.0034 \cdot \cos(5 \cdot 6.28t + \frac{\pi}{2}) \\
&\qquad \text{when } \pi_k \leqq 6.28t \leqq \pi_{(k+1)} \\
&\frac{V_t}{0.045} = 0 \qquad \text{when } \pi_{(k+1)} \leqq 6.28t \leqq \pi_{(k+2)}
\end{aligned}\right\}$$

Thus, a stable continuous casting process yields ingots of uniform cross-section, containing fine lamellar pearlite of fine-grained strusture, with the hardness of 363 Hb, and density of 7870 kg/m$^3$.

Physical and chemical properties of the steel are homogeneous throughout its volume, nonmetallic inclusions contained therein are at minimum, carbide particle distribution being uniform. The ingots are free from porosity and other macrodefects. There is no decarburized zone on the ingot surface. Mechanical treatment of the ingots revealed no defects which could be traced down to the casting process. The articles fabricated therefrom have been found to comply with requirements for ball races.

EXAMPLE 5

An ingot of 102 mm in diameter and with the wall thickness of 7 mm for radiant tubes from steel of the following composition: 0.24% C; 0.87 Si; 0.63% Mn; 16.7% Cr; 18.7% Ni; 2.8% Al; 0.016% S; said ingot being cast in the mold of 0.2 m high in the following manner.

The rate of heat removal from the surface of the ingot 4 within the mold 3 is regulated over the entire height of the mold 3. The empirical coefficients in the aforementioned formula (1) are $$a = 3174,\ b = -0.26$$

Thus, the variation in the rate of heat removal is determined from the formula $$\alpha = 3174(h/0.2)^{-0.26}$$

The withdrawal of the ingot 4 is carried on continuously in a stepwise manner at an average rate of 0.015 m/sec, its travelling speed being changed during withdrawal cycle according to the above-mentioned formula (2), where $V_{max} = 0.06$ m/sec;
$\omega = 3.14$ sec$^{-1}$;
$A_o = 0.23$; $A_1 = 0.4005$; $A_2 = 0.23$;
$A_3 = 0.1289$; $A_4 = 0.0363$; $A_5 = 0.0034$;

$$\epsilon_1 = \pi/2;\ \epsilon_2 = -\pi;\ \epsilon_3 = -\pi/2;\ \epsilon_4 = \pi/2;\ \epsilon_5 = -\pi/2$$

Thus, the change in the travelling speed of the ingot 4 during withdrawal cycle is determined from the following formula:

$$\left.\begin{aligned}
&\frac{V_t}{0.06} = 0.23 + 0.4005 \cdot \cos(3.14t - \frac{\pi}{2}) + \\
&0.23 \cdot \cos(2 \cdot 3.14t + \pi) + 0.1289 \cdot \cos(3 \cdot 3.14t + \frac{\pi}{2}) + \\
&0.0363 \cdot \cos(4 \cdot 3.14t - \frac{\pi}{2}) + 0.0034 \cdot \cos(5 \cdot 3.14t + \frac{\pi}{2}) \\
&\qquad \text{when } \pi_k \leqq 3.14 \leqq \pi_{(k+1)} \\
&\frac{V_t}{0.06} = 0 \qquad \text{when } \pi_{(k+1)} \leqq 3.14t \leqq \pi_{(k+2)}
\end{aligned}\right\}$$

As a result, a stable continuous casting process is enabled to yield the ingot 4 of uniform cross-section, featuring good quality of inner and outer surfaces, with the metal density of 7660 kg/m$^3$. The steel is austenitic in microstructure, containing inclusions of chromium carbide. Heat resistance at 900° C. is 0.065 g/m$^2$. hour, at 1000° C. it is 0.087 g/m$^2$.hour, and 0.23 g/m$^2$.hour at 1100° C. Tensile strength is 62.8 kgf/mm$^2$, relative elongation is 32.5%, relative shrinkage is 32,2%, impact strength is 1,578 J/m$^2$. Tensile strength at 930° C. is 10.4 kgf/mm$^2$, relative elongation is 27.9%, and relative shrinkage is 28%.

The radiant tubes fabricated from the hollow ingots cast in accordance with the herein proposed process have been tested under mill conditions in industrial furnaces for nomalizing steel ingots and operated continuously for 9250 hours at a temperature of 900° C.

EXAMPLE 6

An ingot of 170 mm in diameter and with the wall thickness of 8 mm for radiant tubes made of steel having the following composition: 0.19% C; 0.82% Si; 0.61% Mn; 24.6% Cr; 20.0% Ni; 0.010% S; said ingot being cast in the mold of 0.25 m height in the following manner.

The rate of heat removal from the ingot 4 within the mold 3 is regulated over the entire height of the mold 3.

The empirical coefficients in the above-mentioned formula (1) are the following:

$$a = 5380;\ b = -0.15$$

Thus, the variation in the rate of heat removal is determined from the formula $$\alpha = 5380(h/0.25)^{-0.15}$$

The withdrawal of the ingot 4 is carried on continuously in a stepwise manner at an average rate of 0.027 m/sec, the ingot travelling speed being changed during withdrawal cycle according to the aforementioned formula (2), where $V_{max} = 0.108$ m/sec;
$\omega = 8.48$ sec$^{-1}$;
$A_o = 0.23$; $A_1 = 0.4005$; $A_2 = 0.23$;
$A_3 = 0.1289$; $A_4 = 0.0363$; $A_5 = 0.0034$;

$$\epsilon_1 = \pi/2;\ \epsilon_2 = -\pi;\ \epsilon_3 = -\pi/2;\ \epsilon_4 = \pi/2;\ \epsilon_5 = -\pi/2$$

Thus, the change in the travelling speed of the ingot 4 during withdrawal cycle is calculated with the following formula:

$$\left.\begin{aligned}
&\frac{V_t}{0.108} = 0.23 + 0.4005 \cdot \cos(8.48t - \frac{\pi}{2}) + \\
&0.23 \cdot \cos(2 \cdot 8.48t + \pi) + 0.1289 \cdot \cos(3 \cdot 8.48t + \frac{\pi}{2}) + \\
&0.0363 \cdot \cos(4 \cdot 8.48t - \frac{\pi}{2}) + 0.0034 \cdot \cos(5 \cdot 8.48t + \frac{\pi}{2}) \\
&\qquad \text{when } \pi_k \leqq 8.48t \leqq \pi_{(k+1)} \\
&\frac{V_t}{0.108} = 0 \qquad \text{when } \pi_{(k+1)} \leqq 8.48 \leqq \pi_{(k+2)}
\end{aligned}\right\}$$

As a result, a stable continuous casting process is enabled to yield the ingot 4 of uniform cross-section, with good quality of its inner and outer surfaces. The microstructure of the steel is composed of gamma polyhedral grains of solid solution and chromium carbide, located inside the grains as well as at the boundaries thereof. Heat resistance at 900° C. is 0.058 g/m$^2$.hr; at 1000° C., 0.078 g/m$^2$.hr; and at 1100° C. it is 0.19 g/m$^2$.hr.

The radiant tubes fabricated from the ingots thus produced have been tested under mill conditions in industrial furnaces for normalizing steel ingots and operated continuously for 11750 hours at a temperature of 930° C.

When nonferrous metals and alloys are poured into the interior of the mold 3, the rate of heat removal should be regulated over the entire height of the mold according to the formula (1), the empirical coefficients a and b being selected within the following range:

$$300 \leqq a \leqq 10000$$

$$-8.7 \leqq b \leqq -0.3$$

EXAMPLE 7

An ingot of 89 mm in diameter and with the wall thickness of 27 mm produced from bronze having the following composition: 4.74% Sn; 5.13% Zn; 4.9% Pb; Cu, the balance; said ingot being continuously cast in the mold of 0.2 m high, in the following manner.

The rate of heat removal from the surface of the ingot 4 is regulated throughout the height of the mold 3. The empirical coefficients in the above-mentioned formula (1) are the following:

$$a = 680;\ b = -0.37$$

Thus, the variation in the rate of heat removal is determined from the formula $$a = 680(h/0.2)-0.37$$

The withdrawal of the ingot 4 is carried out continuously in a stepwise manner at an average rate of 0.008 m/sec, its travelling speed being changed during withdrawal cycle according to the above-mentioned formula (2), where $V_{max} = 0.032$ m/sec;

$\omega = 3.14$ sec$^{-1}$;

$A_o = 0.23;\ A_1 = 0.4005;\ A_2 = 0.23;$ $A_3 = 0.1289;\ A_4 = 0.0363;\ A_5 = 0.0034;$ $\epsilon_1 = \pi/2;\ \epsilon_2 = -\pi;\ \epsilon_3 = -\pi/2;\ \epsilon_4 = \pi/2;\ \epsilon_5 = -\pi/2$ Thus, the change in the travelling speed of the ingot 4 during withdrawal cycle is calculated with the following formula $$\left.\begin{aligned} \frac{V_t}{0.032} &= 0.23 + 0.4005 \cdot \cos(3.14t - \tfrac{\pi}{2}) + \\ &0.23 \cdot \cos(2 \cdot 3.14t + \pi) + 0.1289 \cdot \cos(3 \cdot 3.14t + \tfrac{\pi}{2}) + \\ &0.0363 \cdot \cos(4 \cdot 3.14t - \tfrac{\pi}{2}) + 0.0034 \cdot \cos(5 \cdot 3.14t + \tfrac{\pi}{2}) \\ \frac{V_t}{0.032} &= 0 \qquad \text{when } \pi_k \leqq 3.14t \leqq \pi_{(k+1)} \\ \frac{V_t}{0.032} &= 0 \qquad \text{when } \pi_{(k+1)} \leqq 3.14t \leqq \pi_{(k+2)} \end{aligned}\right\}$$

As a result, a stable continuous casting process yields ingots of uniform cross section, featuring fine crystalline structure of high density. The ingots thus produced have the following properties: hardness, 87 HB; density 8710 kg/m$^3$; tensile strength, 32 kgf/mm$^2$. Mechanical treatment of the ingots revealed no defects which could be traced down to the casting process.

EXAMPLE 8

An ingot of 101 mm in diameter and with the wall thickness of 3.1 mm from aluminium of the following composition: 99.99% Al; 0.003% Fe; 0.003% Si; 0.002 Cu; 0.002 Zn; said ingot being cast in the mold of 0.2 m high in the following manner.

The rate of heat removal from the surface of the ingot 4 within the mold 3 is regulated over the entire height of the mold 3. The empirical coefficients in the above-mentioned formula (1) are the following:

$$a = 890;\ b = -0.63$$

Thus, the variation in the rate of heat removal is determined from the following formula:

$$\alpha = 890(h/0.2)^{-0.63}$$

The withdrawal of the ingot 4 is carried on continuously in a stepwise manner at an average rate of 0.024 m/sec, its travelling speed being changed during withdrawal cycle according to the above-mentioned formula (2), where $V_{max} = 0.059$ m/sec;

$\omega = 6.28$ sec$^{-1}$;

$A_o = 0.23;\ A_1 = 0.4005;\ A_2 = 0.23;$ $A_3 = 0.1289;\ A_4 = 0.0363;\ A_5 = 0.0034;$ $\epsilon_1 = \pi/2;\ \epsilon_2 = -\pi;\ \epsilon_3 = -\pi/2;\ \epsilon_4 = \pi/2;\ \epsilon_5 = -\pi/2$ Thus, the change in the travelling speed of the ingot 4 is calculated with the following formula:

$$\left.\begin{aligned} \frac{V_t}{0.059} &= 0.23 + 0.4005 \cdot \cos(6.25t - \tfrac{\pi}{2}) + \\ &0.23 \cdot \cos(2 \cdot 6.28 + \pi) + 0.1288 \cdot \cos(3 \cdot 6.28t + \tfrac{\pi}{2}) + \\ &0.0363 \cdot \cos(4 \cdot 6.28t - \tfrac{\pi}{2}) + 0.0034 \cdot \cos(5 \cdot 6.28t + \tfrac{\pi}{2}) \\ \frac{V_t}{0.059} &= 0 \qquad \text{when } \pi_k \leqq 6.28t \leqq \pi_{(k+1)} \\ \frac{V_t}{0.059} &= 0 \qquad \text{when } \pi_{(k+1)} \leqq 6.28 \leqq \pi_{(k+2)} \end{aligned}\right\}$$

As a result, a stable continuous casting process yields an ingot of uniform cross section and with dense structure, having the following properties: hardness, 13.3 HB; tensile strength, 19 kgf/mm$^2$; density, 2700 kg/m$^3$.

Mechanical treatment of such ingots revealed no defects which could be traced down to the casting process.

EXAMPLE 9

An ingot of 103 mm in diameter and with the wall thickness of 12 mm from brass having the following composition: 57% Cu; 41.7% Zn; 1.3% Pl; said ingot being cast in the mold of 0.2 m high in the following manner.

The rate of heat removal from the surface of the ingot 4 within the mold 3 is regulated throughout the height of the mold 3. The empirical coefficients in the above-mentioned formula (1) are the following:

$$a = 950;\ b = -0.5$$

Thus, the variation in the rate of heat removal is determined from the following formula:

$$\alpha = 950(h/0.2)^{-0.5}$$

The withdrawal of the ingot 4 is carried on continuously in a stepwise manner at an average rate of 0.0237 m/sec, its travelling speed being changed during withdrawal cycle according to the abovementioned formula (2), where $V_{max} = 0.096$ m/sec;

$\omega = 5.026$ sec$^{-1}$;

$A_o = 0.23$; $A_1 = 0.4005$; $A_2 = 0.23$;
$A_3 = 0.1289$; $A_4 = 0.0363$; $A_5 = 0.0034$;

$\epsilon_1 = \pi/2$; $\epsilon_2 = -\pi$; $\epsilon_3 = -\pi/2$; $\epsilon_4 = \pi/2$; $\epsilon_5 = -\pi/2$ Thus, the variation in the travelling speed of the ingot 4 during withdrawal cycle is calculated with the following formula:

$$\left.\begin{aligned} \frac{V_t}{0.096} &= 0.23 + 0.4005 \cdot \cos(5.026t - \frac{\pi}{2}) + \\ &0.23 \cdot \cos(2 \cdot 5.026t + \pi) + 0.1289 \cdot \cos(3 \cdot 5.026t + \frac{\pi}{2}) + \\ &0.0363 \cdot \cos(4\text{–}5.026t - \frac{\pi}{2}) + 0.0034 \cdot \cos(5 \cdot 5.026t + \frac{\pi}{2}) \\ &\qquad \text{when } \pi_k \leqq 5.026t \leqq \pi_{(k+1)} \\ \frac{V_t}{0.096} &= 0 \qquad \text{when } \pi_{(k+1)} \leqq 5.026t \leqq \pi_{(k+2)} \end{aligned}\right\}$$

As a result, a stable continuous casting process yields an the ingot of uniform cross section and dense structure composed of alpha and betta crystalls of elongate shape. The ingots have the following physical properties: hardness, 104 HB; density, 8380 kg/m$^3$; tensile strength, 55 kgf/mm$^2$. Mechanical treatment of such ingots revealed no defects which could be traced down to the casting process.

The herein disclosed apparatus for continuous casting of hollow ingots comprises a water-cooled mold 3 (FIG. 1), having the inner surface thereof smoothly flaring upwardly, i.e. shaped to the form of inverted truncated cone, with diameter $D_2$ of its upper base being larger than diameter $D_1$ of the lower base. The upper part of the mold 3 a cylinder-shaped portion 7 which is formed with annular slots 8 with diameter $D_3$. Diameter $D_4$ of projections 9, formed by the slots, is slightly less than diameter $D_2$ of the truncated cone upper base; the slots 8 are smoothly passing into the projections 9. Diameter $D_1$ or $D_2$ of either base of the truncated cone is substantially smaller than height H of the mold 3.

The mold 3 is coupled with the bottom gate 2 through a connecting sleeve 10 of refractory material. Arranged above the mold 3 are detachable screens 11 adapted to vary the rate of cooling of the ingot 4 outside the mold 3. Also arranged above said mold are the withdrawal means 5 and the cut-off means 6.

According to the herein proposed process and apparatus for the continuous casting of hollow ingots, the process of casting and formation of the continuous ingot will be described below by way of example illustrating the production of hollow ingots from pig iron.

Molten iron from the ladle 1 (FIG. 1) is continuously fed through the bottom gate 2 and the connecting sleeve 10 into the mold 3. The solidified metal skin 4, formed at the mold interior surface, is continuously withdrawn upwardly in a stepwise manner with the aid of the withdrawal means 5. As the continuous ingot issues from the mold 3 for a prescribed length, it is cut to lengths to be stowed away (the stowage is not shown).

During each upward withdrawal cycle of the ingot 4, there is freed within the mold 3 a portion which is equal in size to the height of the shifted ingot. It is just at this portion that molten metal comes into contact with the interior surface of the mold 3 thereby to result in the rapid cooling of the metal and in the formation of the metal skin which fuses with the portion solidified earlier. At the initial stage of the solidification process, there is practically no gap between the continuous ingot 4 and the surface of the mold 3. Therefore, the rate of heat emission from the ingot is fairly high, the coefficient of heat emission from the ingot surface being about $6 \cdot 10^3$ W/m$^2$·deg. Such rate of heat emission causes sharp drop of temperature at the surface of the ingot 4, going down from crystallization temperature to that of 800°–750° C. at the rate of over 100 deg/sec. The crystallization of pig iron is accompanied by the formation of austenite dendrites along with cementite and separate inclusions of graphite. During subsequent withdrawal cycle of the ingot 4, the portion under consideration is shifted to the upper zones wherein there appears in the interspace between the surface of the ingot 4 and the mold 3 a gas gap 12 created due to the increases diameter of the mold 3 and shrinkage of the solidified metal.

With the diameter of the mold 3 being increased in direction of the the upwardly withdrawn ingot 4, each section of the mold 3 is formed with the gap 12 to enable a prescribed rate of heat removal from the surface of the ingot 4 throughout the time of its formation. In addition, the provision of the gap 12 considerably diminishes the force of friction between the solidified skin or ingot 4 and the working surface of the mold 3. In the mid-zone of the mold 3 the coefficient of heat emission goes down to $(3\text{–}1) \cdot 10^3$ W/m$^2$·deg., which creates optimal conditions for crystallization of pig iron, accompanied by the formation of austenite dendrites and graphite eutectic, and prevents the formation of cementite. In the upper zone of the mold 3 wherein the gap 12 between the ingot 4 and the mold 3 substantially increases due to the provision of the slot 8, the coefficient of heat emission drops to a value of $0.3 \cdot 10^3$ W/m$^2$·deg. As a result, the temperature of the outer surface of the ingot 4 increases up to 920°–980° C., at which temperature cementite, formed in the outer layers of the solidifying skin of the ingot 4, is liable to decompose. The annular projections 9 in the slot 8 prevent the formation of irregularities at the surface of the ingot 4 slipping therealong. Here, smooth passage from the slots 8 to the projections 9 assures gradual change in the rate of heat emission and protects the mold 3 from damage. On issuing from the mold 3, the ingot 4 has a temperature of about 950° C., the process of cementite decomposition still going on. The cooling of the ingot 4 outside the mold 3 down to a temperature of 670 to 720° C. is carried on in the air at an average rate of 0.9 to 1.1 degrees per second or at the rate of 0.4 to 0.6 degrees per second. This cooling rate control is effected by means of the screen 11 mounted above the mold 3, or by applying forced cooling procedure when the cooling rate is within the range of from 2 to 20 deg. per second. In the first case the ingot has pearlitic structure, in the second, ferritic and pearlitic, and in the third case it has beinite, sorbite, troostite or martensite structure.

The resultant ingot is uniform in cross section, free from hard spots, having a prescribed structure of metallic matrix as well as fine-, and medium-flaked graphite inclusions in the middle and inner layers of the ingot wall. Present in the outer layer of the ingot wall with a thickness of 1.5 to 2.5 mm is interdendritic graphite, but this layer is, as a rule, designed for mechanical treatment.

Too large a gap between the ingot and the mold will result in partial fusion of the solidifying skin and its subsequent rupture, whereas small gap does not allow requisite conditions to be created for the pig iron crystallization without formation of cementite. Excessive height of the mold will lead to overcooling of the molten bath within the mold, as well as to bridging. Insufficient height of the mold will not ensure the production of the ingot of a prescribed cross section.

Withdrawal of the ingot according to a preset intermittent cycle enables gradual increase in the travelling speed of the ingot from zero to the maximum value during each withdrawal cycle, which prevents sharp dynamic load from acting on the solidifying skin of metal.

From the above, it follows that the present invention makes it possible to rectify the following defects which may arise in the the process of casting, namely: shrinkage and gaseous porosity, nonmetallic inclusions, gas cavities, structure discrepancy, etc. Regulation of heat removal from the solidifying and cooling ingot permits of controlling the process of its formation, as well as producing the ingots with prescribed structure and physical-and-mechanical properties. The process and apparatus of the invention provide for high operating efficiency (the rate of the ingot withdrawal may reach 0.5 m/sec), lend themselves readily to automation and mechanization, being as well adaptable for application on installations with a plurality of process lines. Likewise, the present invention substantially facilitates and improves the production process since it does not contemplate the production of casting molds and cores and, therefore precludes such operations as knocking out, fettling and dressing of castings.

What is claimed is:

1. A process for continuous casting of hollow ingots, comprising delivering molten metal through a bottom gate into the interior of a water-cooled mold wherein the skin of metal solidifies at the inner surface of said mold to form an ingot; the rate of heat emission from the surface of said ingot within said mold being varied gradually over the height of said mold from a given maximum value in the metal skin formation zone to a given minimum value at the emergence of said ingot from said mold; said ingot being continuously withdrawn from said mold upwardly in a stepwise manner, remaining in motion with respect to said mold during the first half of the travelling cycle and stationary during the second half thereof, the speed of withdrawal of said ingot from said mold being gradually increased during each withdrawal cycle from zero to the maximum value for a length of time equal to a half the travelling time of said ingot, said speed being then gradually decreased back to zero for the same amount of time wherein the rate of heat emmission from the ingot at each point over the height of the mold is determined from the following formula:

$$L = a\,(h/H)\,b,$$

where

- $\alpha$ - is the coefficient of heat emission from the surface of the ingot, ($W/m^2 \cdot deg$);
- h - is the height of the mold at which is determined the rate of heat emission, (m);
- H - is the overall height of the mold, (m);
- a - is an empirical coefficient depending on the material of the ingot, ($W/m^2 \cdot deg$);
- b - is a nondimensional empirical coefficient depending on the material of the ingot, and wherein the speed of withdrawal of the ingot from the mold during each withdrawal cycle is determined from the formula:

$$\left.\begin{aligned} \frac{V_t}{V_{max}} &= A_o + \sum_{n=1}^{\infty} An \cdot \cos(n\omega t - \epsilon_n) \\ &\qquad \text{when } \pi_k \leqq \omega t \leqq \pi_{(k+1)} \\ \frac{V_t}{V_{max}} &= A_o + \sum_{n=1}^{\infty} An \cdot \mathrm{Cos}(n\omega t - \epsilon_n) = 0 \end{aligned}\right\}$$

-continued when $\pi_{(k+1)} = \omega t \leqq \pi_{(k+2)}$ where

- $V_t$ - is the current value of the withdrawal speed of the ingot from the mold during its travelling cycle, (m/sec);
- $V_{max}$ - is the maximum value of the ingot withdrawal speed during its travelling cycle, (m/sec);
- $A_o$ - is the free coefficient of a Fourier series;
- $A_n$ - is the amplitude of oscillation of the corresponding harmonic component of the Fourier series;
- n - is the aqueous of natural numbers 1,2,3,4 . . . ;
- $\omega = 2\pi/T$ — is the pulsatance of the ingot travelling speed, $(sec)^{-1}$;
- T is the oscillation period of the ingot travelling speed; (sec);
- t - is the current time of the ingot withdrawal, (sec);
- $\epsilon_n$ - is the epoch angle of the corresponding harmonic component of the Fourier series, (rad);
- K - is the sequence of even numbers 0,2,4,6, . . .

2. A process for continuous casting of hollow ingots from pig iron as claimed in claim 1, wherein the rate of heat emission is regulated throughout the height of the mold, the empirical coefficients a and b being selected within the following range:

$$200 \leqq a \leqq 2500$$
$$-1.2 \leqq b \leqq -0.6$$

3. A process for continuous casting of hollow ingots from steel as claimed in claim 1, wherein the rate of heat emission is regulated throughout the height of the mold, the empirical coefficients being selected within the following range:

$$1000 \leqq a \leqq 12000$$

$$-0.6 \leqq b \leqq -0.1$$

4. A process for continuous casting of ingots from nonferrous metals as claimed in claim 1, wherein the rate of heat emission is regulated throughout the height of the mold, the empirical coefficients being selected within the following range:

$$300 \leqq a \leqq 10000$$

$$-0.7 \leqq b \leqq -0.3.$$

5. An apparatus for continuously casting hollow ingots, comprising a bottom gate into which molten metal is introduced, a coupling sleeve in communication with said bottom gate; a mold arranged above said coupling sleeve and in communication therewith, the lower internal portion of said mold being in the shape of a diverging truncated cone travelling upwardly and having an internal diameter at the widest point which is substantially less than the height of said mold, the upper internal portion of said mold being of cylindrical shape and having annular slots formed therein, a detachable screen being disposed in close relation to the ingot which is continuously withdrawn from said mold which screen regulates the cooling rate of the ingot, and a withdrawal means disposed above said mold for continuously withdrawing upwardly the formed ingot.

6. An apparatus as in claim 5, wherein the diameter of the upper portion of said mold between said annular slots is less than that of the largest internal diameter of the lower portion of the mold which is in the shape of a truncated cone.

7. An apparatus as in claim 5, wherein the surface of the upper portion of said mold between said annular slots is smooth.

* * * * *

UNITED STATES PATENT OFFICE

CERTIFICATE OF CORRECTION

PATENT NO. : 4,146,079

DATED : March 27, 1979

INVENTOR(S) : ANISOVICH, Gennady Anatolievich et al

It is certified that error appears in the above-identified patent and that said Letters Patent are hereby corrected as shown below:

IN THE ABSTRACT:

Line 9, After "of time" insert -- equal to half the traveling time of the ingot, said speed being then gradually decreased back to zero for the same amount of time--.

Line 10, Delete "in accordance".

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*